United States Patent [19]

Mayfield

[11] Patent Number: 5,022,678

[45] Date of Patent: Jun. 11, 1991

[54] SKI SLEEVE

[76] Inventor: Timothy N. Mayfield, 4605 SW. 54th Pl., Portland, Oreg. 97221

[21] Appl. No.: 552,349

[22] Filed: Jul. 16, 1990

Related U.S. Application Data

[63] Continuation of Ser. No. 310,694, Feb. 15, 1989, abandoned.

[51] Int. Cl.[5] ..... A63C 11/02

[52] U.S. Cl. ..... 280/815; 150/154; 280/814

[58] Field of Search ..... 280/814, 815; 150/160, 150/154; 294/147

[56] References Cited

U.S. PATENT DOCUMENTS

| | | | |
|---|---|---|---|
| 2,180,686 | 11/1939 | Lorinovich | 280/815 |
| 2,250,388 | 7/1941 | Mickelberg | 280/815 |
| 3,336,961 | 8/1967 | Welsh | 280/814 |
| 3,731,348 | 5/1973 | Luehne | 280/814 |
| 3,851,689 | 12/1974 | Kohls | 280/814 |
| 3,909,031 | 9/1975 | Schmaedeke et al. | 280/814 |
| 3,948,302 | 4/1976 | Kohls | 280/814 |
| 4,055,287 | 10/1977 | Champemois, Jr. | 280/814 |
| 4,191,233 | 3/1980 | McKay | 280/814 |
| 4,674,787 | 6/1987 | DeVera | 280/814 |
| 4,715,416 | 12/1987 | Horne | 280/814 |
| 4,772,047 | 9/1988 | Leaf | 280/815 |
| 4,830,403 | 5/1989 | Ohmori | 280/815 |

FOREIGN PATENT DOCUMENTS

| | | | |
|---|---|---|---|
| 97838 | 1/1940 | Sweden | 280/815 |

*Primary Examiner*—Andres Kashnikow
*Assistant Examiner*—Eric Culbreth
*Attorney, Agent, or Firm*—Marger, Johnson, McCollom & Stolowitz, Inc.

[57] ABSTRACT

A tip ski sleeve slips over a tip portion of a ski and a heel ski sleeve slips over a heel portion of the ski. Each of the ski sleeves includes a hollow elongate sleeve body having an open end for receiving the respective end portion of the ski and a closed end for maintaining the sleeve positioned on the respective end of the ski. Each ski sleeve further includes an elongate strap, stretchable to extend around a second ski positioned adjacent the ski and attachable at the free end to the sleeve for removably holding the skis together.

4 Claims, 1 Drawing Sheet

SKI SLEEVE

This is a continuation of copending application(s) Ser. No. 07/310,694 filed on Feb. 15, 1989, now abandoned.

BACKGROUND OF THE INVENTION

This invention relates generally to skiing and, more particularly to convenient apparatus and methods for storing and transporting a pair of skis when not in use.

Various bags and protective coverings are known for carrying skis, particularly snow skis. Some ski bags are large enough to contain a pair of skis. Examples of such bags are shown in U.S. Pat. No. 3,336,961, U.S. Pat. No. 2,250,388, U.S. Pat. No. 2,180,686, and U.S. Pat. No. 3,909,031. Other protective coverings for skis comprise two separate bags, one bag for holding each one of a pair of skis. Typically, means also are provided for holding the two ski bags together to form one unit. Examples of such ski covers are shown in U.S. Pat. No. 4,191,233 and U.S. Pat. No. 4,715,416. On the whole, ski bags such as those described above are bulky and heavy. As a result, they cannot conveniently be carried by a skier while skiing. A safe place must be found for storing such ski covers or bags when not in use.

Protective coverings also are known for covering bindings on skis. Examples of such devices are shown in U.S. Pat. No. 4,055,287 and U.S. Pat. No. 4,674,787. These devices cover only a central region of a pair of skis, to protect the bindings, and accordingly leave both ends of the skis exposed to being scratched and marred. Generally, all of the ski covers and bags known to this inventor are bulky, expensive, and cumbersome to use and to carry.

A relatively small and lightweight device for holding a pair of skis together is shown in U.S. Pat. No. 3,731,348. That patent shows a pair of elongate ski straps. Such straps are difficult to use, as installation requires positioning a first strap between the two skis near one end of the skis; holding the skis and strap in that position by squeezing the skis together at the strap location; and then wrapping the strap around both skis while maintaining pressure to hold the skis together to keep the strap from falling out of place. The same process is repeated to install the second strap near the opposite end of the skis. These operations nearly require three hands to perform. While wrapping the first strap between and around the skis, they are likely to chafe at the other ends.

Accordingly, the need remains for a method of maintaining a pair of skis connected together for transporting them as a unit, without the weight, bulk, and expense associated with conventional ski bags or covers.

SUMMARY OF THE INVENTION

An object of the present invention is to provide for connecting a pair of skis together as a unit for ease in carrying them. Another object is to prevent the skis from chafing or abrading each other while they are joined together, so that the face and edges of the skis are maintained in optimal condition for skiing. Yet another object of the invention is to obviate burdening a skier with carrying a bulky ski bag, and finding secure quarters for the bag when not in use.

The invention includes apparatus and methods for securing a pair of skis together. The apparatus generally includes a ski sleeve, adapted to slide over one end of a ski, and having a strap to connect another ski to the first ski. Preferably, a pair of such sleeves are used, one positioned on each end of the first ski.

Each sleeve generally includes a hollow elongate sleeve body, sized to fit over an end portion of a first ski, and strap means fixed to the body for removably connecting the first ski to a second ski positioned in parallel proximity to the first ski. The sleeve body is best formed of a flexible material to facilitate storing the apparatus in a skier's pocket when not in use.

The sleeve body defines an open end, sized to receive an end of the first ski, and a closed end for maintaining the sleeve in a predetermined position engaged on the end of the ski. An elastic cuff is connected around the periphery of the open end for sealing the open end against the first ski to prevent debris from entering the sleeve. The sleeve body is arranged to extend, in use, between the first and second skis so as to prevent the skis from abrading each other.

In a preferred embodiment, one of the pair of ski sleeves is adapted to cover a tip portion of the first ski and the other sleeve is adapted to cover a tail portion of the first ski. An elongate, elastic strap having first and second ends is fixed at the first end to the sleeve body. The strap has a substantially fully-extended length sufficient to wrap around the second ski and overlap the sleeve by a predetermined distance. The strap further includes connecting means along a terminal portion of the strap adjacent the second end for connecting the second end of the strap to the sleeve body. Corresponding patches of micro-hook and micro-loop attachment materials, for example the materials sold under the brand name Velcro ®, are connected along a terminal portion of the strap adjacent the second end and connected at a predetermined position on the sleeve body for removably attaching the second end of the strap to the sleeve body. The attachment material is positioned on the sleeve to register with the overlapping portion of the strap.

In one example of a ski sleeve in accordance with the present invention, the sleeve body includes a substantially flat top portion sized to cover the top surface of an end portion of the first ski and a substantially flat face portion, substantially equal in size to the top portion and positioned generally parallel to the top portion. The top portion and the face portion are connected together along a portion of the periphery of each of them thereby defining a seam, the seam defining an aperture sized to receive an end of the first ski inserted between the top and face portions of the sleeve. The strap extends from the seam. It is elastic and adapted to stretch to a length sufficient to wrap around the top of a second ski abutting the first ski in parallel face-to-face relation and further extend over the top portion of the sleeve body.

Methods of removably connecting a pair of skis together for transporting them as a unit are disclosed. The methods include the steps of: providing a pair of ski sleeves, each sized to fit over an end of a ski and having an integral strap extending from the sleeve and defining a free end; sliding the sleeves over the ends of a first ski; positioning a second ski in parallel relation to the first ski; wrapping each strap around the second ski; and connecting the free end of each strap to the respective sleeve.

Another method further includes locating the straps within regions along the first ski where the second ski would contact the first ski, thereby preventing abrasion between the skis. Additionally, the claimed methods include, where the provided sleeves each including micro-hook and micro-loop attachment patches connected at a terminal portion of the strap and at a predetermined location on the sleeve, connecting the free end of the strap by overlapping the free end over the sleeve, so that the attachment patch on the strap registers with the corresponding attachment patch on the sleeve, and pressing the free end onto the sleeve to engage the attachment patches.

The foregoing and other objects, features and advantages of the invention will become more readily apparent from the following detailed description of a preferred embodiment which proceeds with reference to the drawings.

DETAILED DESCRIPTION OF THE PREFERRED EMBODIMENT

Figure 1:
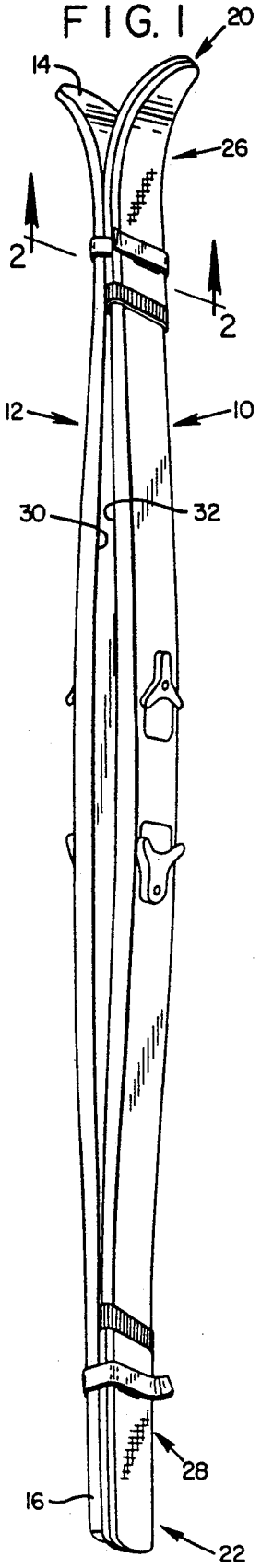
FIG. 1 is a perspective view of a pair of ski sleeves in accordance with the present invention in use on a pair of skis.

FIG. 1 is a perspective view of a pair of skis with a pair of ski sleeves installed on the skis in accordance with the present invention. A first ski 10 and second ski 12 are held together by the ski sleeves so that the bottom surfaces 30, 32 respectively of the two skis face each other. A tip sleeve 26 and heel sleeve 28 are installed to protect the skis and hold them together in said face-to-face relation as more fully described below.

The first ski 10 includes a tip portion 20 and a heel portion 28. Similarly, the second ski 12 includes a tip portion 14 and a heel portion 16. It is most convenient to arrange the skis heel-to-heel though this is not required by the present invention.

Figure 3:
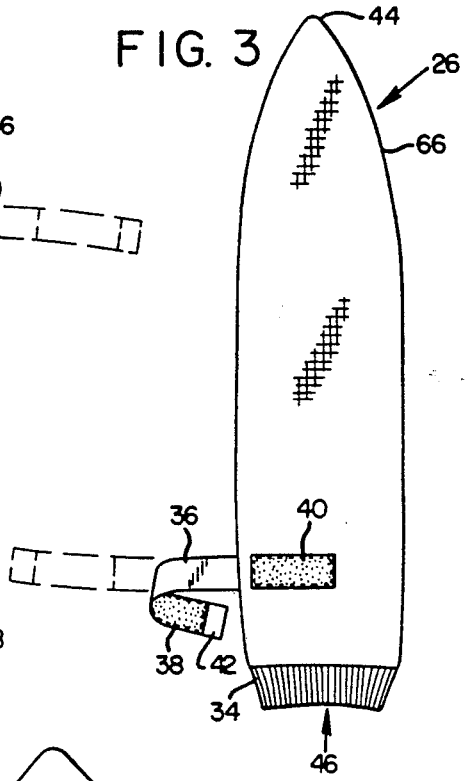
FIG. 3 is a perspective view of the tip sleeve of FIG. 1, showing in phantom the strap portion of the sleeve before wrapping it around a ski.

The tip sleeve 26 is installed over the tip portion 20 of first ski 10 so as to cover the tip portion. Referring to FIG. 3, tip sleeve 26 includes an elongate hollow sleeve body 66. Sleeve body 66 is closed at one end 44 and defines an opening 46 at the end opposite end 44. Opening 46 is sized to receive a ski inserted longitudinally into the sleeve. An elastic cuff 34 is connected around the periphery of opening 46 to prevent rocks or other debris from entering the sleeve which might scratch or mar the surface of the ski.

Figure 2:
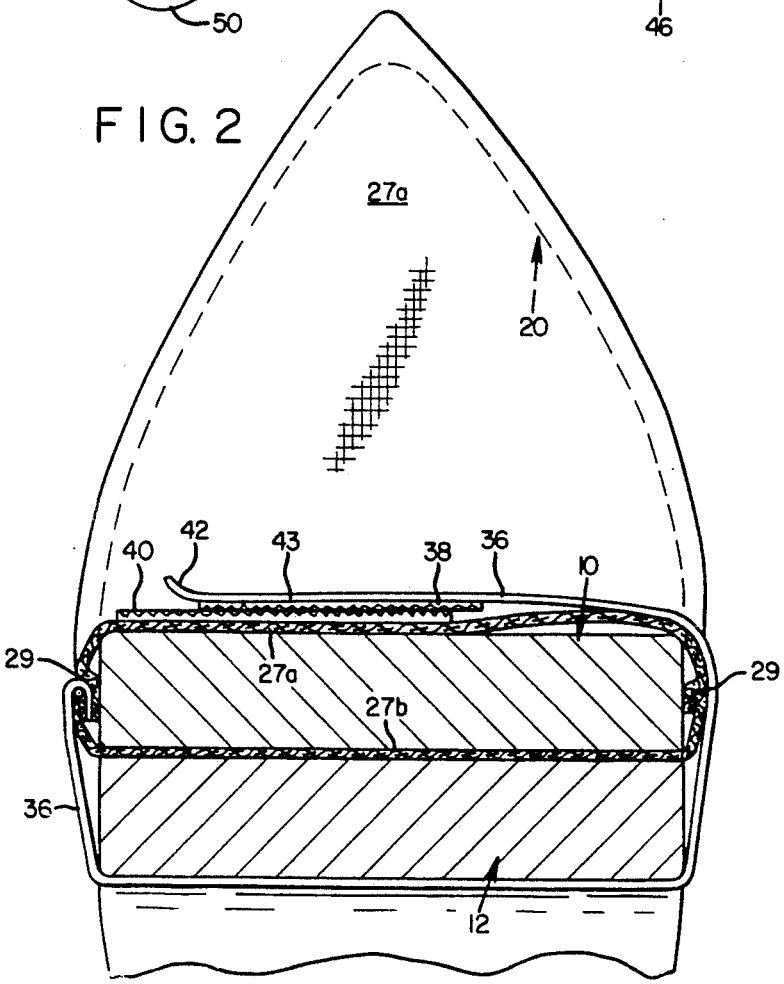
FIG. 2 is an enlarged sectional view of the skis and one of the ski sleeves of FIG. 1, taken along line 2—2 of FIG. 1.

The tip sleeve 26 preferably is made of two pieces of material, interconnected by a seam that extends around the periphery of the sleeve body 66. Referring to FIG. 2, a top piece of material 27*a* is shown interconnected to a bottom piece of material 27*b* along a seam 29. These two portions together form the sleeve body 66.

An elongate strap 36 is connected to the sleeve body 66. The strap is connected into the seam 29 at a location generally adjacent to the lower end of sleeve 26. The strap 36 is generally rectangular and formed of a flexible, elastic fabric. Strap 36 is on the order of ½ to 1 inch wide, though this dimension is not critical. It is formed to allow longitudinal stretch to a length sufficient to wrap around the second ski 12 and overlap the top portion 27*a* of the sleeve body 66, as shown in FIG. 2.

FIG. 2 shows the strap 36 in use. A first end of strap 36 is connected into seam 29 as appears in the left side of FIG. 2. The strap is wrapped around the top side of ski 12, around the edges of both skis, and overlaps the top of ski 10. Strap 36 is removably connected along a terminal portion 43 to the top of sleeve body 66. Said connection may be made by providing a "velcro" strip 38 fixed to the underside of terminal portion 43 of strap 36. The second corresponding strip 40 is fixed to the top side of sleeve body 66. "Velcro" is the trade name of a well-known material comprising micro-hook and micro-loop surfaces that cooperate to removably fasten facing materials together, A suitable fastener of this type is disclosed in U.S. Pat. No. 3,555,630, incorporated herein by this reference.

In one operative example of the tip sleeve 26, it is about 15 inches in overall length. The strap 36 is about ¾ inch wide, made of an elastic material, and the velcro strip 38 is spaced about 2 inches apart from the sleeve when the strap is slack. The elastic material is selected so that it will reach around the skis as described above when stretched. Cuff 34 is elastic and about 1 inch wide.

The length of sleeve 26 and positioning of the strap 36 along the length of the sleeve are designed so that, with the sleeve engaged on an end of a ski, strap 36 is positioned where the ski would contact a second ski positioned in parallel proximity to the first ski, as illustrated in FIG. 1. Slipping the sleeve over the tip of a first ski thus automatically positions the strap in the correct position for connecting the second ski to the first ski. Additionally, sliding the sleeve onto the ski presents the strap for easy connection as it is already fixed at one end and is automatically held in the correct position. Accordingly, it is trivial for the user to grasp the end portion 42 of strap 36, wrap it around second ski 12 and press it on to connect the strap to the top of the sleeve. This arrangement provides for easy, single handed operation. It provides for protective material between the skis, so they do not mar or scratch each other, without requiring the user to insert material between the skis as certain known ski tying straps require.

Figure 4:
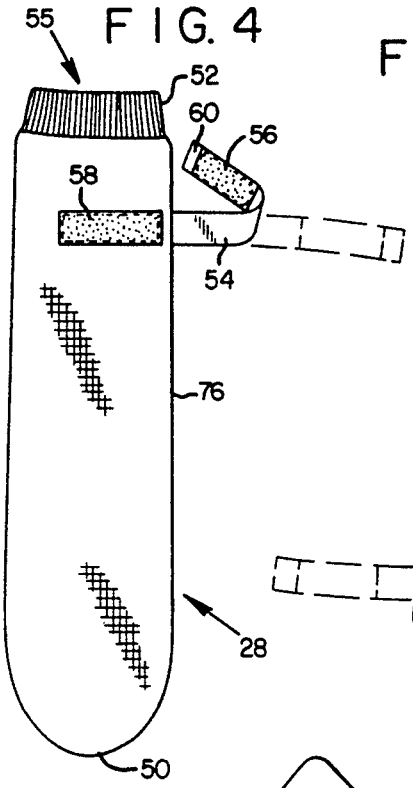
FIG. 4 is a perspective view of the tail of FIG. 1, showing in phantom the strap portion of the sleeve before wrapping it around a ski.

A heel sleeve 28 is provided for use at the heel end of the pair of skis. Referring to FIG. 4, heel sleeve 28 is substantially similar to tip sleeve 26. Heel sleeve 28 includes a sleeve body 76 having an open end 55 surrounded by an elastic cuff 52. Heel sleeve 28 further includes an elongate strap 54 having a velcro strip 56 adjacent the free end 60. A second corresponding velcro patch 58 is provided on top of the heel sleeve 28. The heel sleeve differs from the toe sleeve principally in that the closed end 50 of heel sleeve 28 is shaped to correspond generally to the configuration of the heel end of a ski. This is distinguished from the closed end portion 44 of tip sleeve 26 which is substantially pointed to correspond to the tip end 20 of a ski.

In use, heel sleeve 28 is installed on the heel end of a ski and otherwise used in essentially the same fashion as the tip sleeve. When both sleeves are installed, the skis are held together firmly and without the danger of scratching or marring the bottom surfaces 30, 32 of the skis. The skis are very easily removed or disconnected from each other simply by pulling on the free ends 42, 60 of sleeves 26 and 28 respectively. The user then slides the sleeves off the ends of the second ski 12 and is ready to ski. The very small size and light weight of the sleeves permits them to easily the stored in the skier's pocket until they are needed again.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

I claim:

1. A pair of ski sleeves for removably connecting together a first ski and a second ski and protecting their respective bottom surfaces from damage, comprising:

a first hollow, flexible, elongate sleeve body for closely receiving an uptuned forward end of the first ski, including an open end sized to fit over the upturned forward end of the first ski and a closed end opposite the open end, and which, when fitted over the first ski with the forward end inserted into the sleeve abutting the closed sleeve end, encloses a forward portion of the first ski thereby covering a portion of the first ski bottom surface which would otherwise contact a second ski bottom surface when the skis are positioned with their bottom surfaces adjacent parallel, and facing each other;

a first elongated strap, joined at one end to the first sleeve body with the other end defining a free end, the strap stretchable to a length sufficient to extend around the second adjacent and parallel ski and overlap the first sleeve by a predetermined distance;

means for removably attaching the free end of the first strap to the first sleeve body to connect the first and second skis together;

a second hollow, flexible, elongate sleeve body for closely receiving a rearward end of the first ski, including an open end sized to fit over the rearward end of the first ski and a closed end opposite the open end, and which, when fitted with the rearward end inserted into the sleeve abutting the closed sleeve end, enclose a forward portion of the first ski thereby covering a portion of the first ski bottom surface which would otherwise contact the bottom surface of the second ski when the skis are positioned with their bottom surfaces adjacent, parallel and facing each other;

a second elongated strap, joined at one end to the second sleeve body with the other end defining a free end, the second strap stretchable to a length sufficient to extend around the second adjacent and parallel ski and overlap the second sleeve by a predetermined distance;

means for removably attaching the free end of the second strap to the second sleeve body to connect the first and second skis together;

the first and second sleeves sized so that, in use, a central portion of the first ski remains uncovered; and the first and second ski sleeves fittable over said respective end portions of only the first ski so that the second ski remains substantially uncovered.

2. An apparatus according to claim 1 wherein each sleeve body is formed of a flexible material and includes a flat top portion and a flat face portion connected together along a peripheral seam such that the top portion and the face portion in combination define a pocket for receiving an end of the first ski, and which, when not in use, is foldable to a reduced size for storage in a user's pocket.

3. The apparatus according to claim 1 wherein:

each sleeve further comprises an elastic cuff connected around the periphery of the open end for sealing the open end against the first ski to prevent debris from entering the open end.

4. An apparatus according to claim 1 wherein:

the first strap and second strap attachment means each comprise a patch of micro-loop material connected along a terminal portion of the strap adjacent the free end, and a patch of micro-hook material attached to each respective sleeve at a predetermined position for engaging with the corresponding micro-loop material attached to the overlapping portion of the sleeve's strap when extended to encircle the second ski, thereby removably connecting the first ski to the second ski.

* * * * *